US009138052B2

(12) United States Patent
Kagramanyan

(10) Patent No.: US 9,138,052 B2
(45) Date of Patent: Sep. 22, 2015

(54) PORTABLE STORAGE APPARATUS

(71) Applicant: Norik Kagramanyan, Glendale, CA (US)

(72) Inventor: Norik Kagramanyan, Glendale, CA (US)

( * ) Notice: Subject to any disclaimer, the term of this patent is extended or adjusted under 35 U.S.C. 154(b) by 101 days.

(21) Appl. No.: 13/726,601

(22) Filed: Dec. 25, 2012

(65) Prior Publication Data

US 2014/0062277 A1 Mar. 6, 2014

Related U.S. Application Data

(60) Provisional application No. 61/696,741, filed on Sep. 4, 2012.

(51) Int. Cl.
*A47B 61/00* (2006.01)
*A47B 61/04* (2006.01)

(52) U.S. Cl.
CPC ..... *A47B 61/00* (2013.01); *A47B 61/04* (2013.01); *Y10T 29/49826* (2015.01)

(58) Field of Classification Search
CPC ..... A47B 19/04; A47B 19/06; A47B 25/00; A47B 31/00; A47B 46/00; A47B 49/00; A47B 61/00; A47B 61/02; A47B 61/04; A47B 63/00; A47B 67/04; A47B 81/00; A47B 83/00; A47B 2088/0403; A45C 9/00; A47G 25/0671; B62B 3/002; B65D 88/14; B25H 3/00; B25H 3/028
USPC ..... 312/233, 237, 283, 285, 286, 290, 312/249.1, 249.8, 249.11, 321; 211/34, 36
See application file for complete search history.

(56) References Cited

U.S. PATENT DOCUMENTS

| | | | | | |
|---|---|---|---|---|---|
| 1,231,713 | A | * | 7/1917 | Cummings | 211/38 |
| 1,589,198 | A | * | 6/1926 | McComb | 211/150 |
| 1,608,456 | A | * | 11/1926 | Abdouch | 312/128 |
| 1,752,699 | A | * | 4/1930 | Ross | 211/134 |
| 2,276,141 | A | | 3/1942 | Atkinson | |
| 2,454,148 | A | | 11/1948 | Fought, Jr. | |
| 2,716,046 | A | * | 8/1955 | Minturn | 312/286 |
| 2,896,789 | A | | 7/1958 | Sans et al. | |
| 2,904,383 | A | | 9/1959 | Potts | |
| 2,947,422 | A | * | 8/1960 | Sudbery | 211/47 |
| 3,144,946 | A | | 8/1964 | Ellis | |
| 3,185,536 | A | | 5/1965 | Armstrong | |
| 3,499,541 | A | | 3/1970 | Mackie | |
| 3,620,377 | A | * | 11/1971 | Holtz | 211/206 |
| 3,974,917 | A | | 8/1976 | Waxmanski | |
| 3,995,925 | A | | 12/1976 | Roesler | |
| 4,160,571 | A | * | 7/1979 | Bigotti | 312/327 |

(Continued)

*Primary Examiner* — Daniel Rohrhoff
*Assistant Examiner* — Ryan A Doyle
(74) *Attorney, Agent, or Firm* — Loza & Loza LLP; Razmig Messerian

(57) ABSTRACT

One feature provides a portable storage apparatus that comprises a frame, a hanger rod, a shoe shelf, and a drawer. The hanger rod, the shoe shelf, and the drawer are coupled to the frame. The hanger rod is adapted to receive and support garment hangers and garments. The shoe shelf is adapted to receive and support shoes. The drawer includes a cavity that may receive and store a plurality of objects, including clothing, toys, and books. The shoe shelf may include two surfaces that are angled with respect to each other and the ground. The drawer may be either a one-way drawer that opens from the front side of the apparatus or a two-way drawer that opens from the front and the rear of the apparatus. The apparatus may further comprise a plurality of wheels that are attached to the bottom of the apparatus to allow for easier mobility.

20 Claims, 15 Drawing Sheets

(56) References Cited

U.S. PATENT DOCUMENTS

| | | | | | |
|---|---|---|---|---|---|
| 4,324,076 | A | * | 4/1982 | Honickman | 52/27 |
| 4,456,316 | A | * | 6/1984 | Lundgren | 312/229 |
| 5,090,725 | A | | 2/1992 | Feldner | |
| 5,259,668 | A | * | 11/1993 | Teufel et al. | 312/249.11 |
| 5,533,799 | A | * | 7/1996 | Nickolaus, Jr. | 312/249.12 |
| 5,582,306 | A | * | 12/1996 | Balter et al. | 211/187 |
| 5,865,517 | A | | 2/1999 | Wang | |
| 6,102,216 | A | * | 8/2000 | Frank | 211/85.3 |
| 6,401,947 | B1 | | 6/2002 | Hu et al. | |
| 7,048,131 | B2 | * | 5/2006 | Gay et al. | 211/187 |
| 7,219,904 | B1 | | 5/2007 | Boom | |
| 7,854,444 | B2 | * | 12/2010 | Zhuang | 280/651 |
| 8,561,819 | B1 | * | 10/2013 | Scott | 211/85.3 |
| 8,567,615 | B1 | * | 10/2013 | Rainey | 211/36 |
| 2005/0252869 | A1 | * | 11/2005 | Graham | 211/36 |
| 2006/0022419 | A1 | | 2/2006 | Phillips, II | |
| 2008/0135509 | A1 | * | 6/2008 | Jackson | 211/123 |
| 2008/0252190 | A1 | * | 10/2008 | Utz et al. | 312/257.1 |

* cited by examiner

PORTABLE STORAGE APPARATUS

CLAIM OF PRIORITY

The present application for patent claims priority to U.S. Provisional Patent Application No. 61/696,741 entitled "Portable Clothing and Shoe Organizer" filed Sep. 4, 2012, the entire disclosure of which is hereby expressly incorporated by reference herein.

BACKGROUND

1. Technical Field

Various embodiments of the present disclosure pertain generally to storage apparatuses, and more specifically to portable clothing and shoe organizer apparatuses.

2. Background Art

Various clothing organizer apparatuses that store and/or display clothing and shoes are known in the prior art. However, such organizers suffer from various disadvantages and are not well suited for use with children's apparel. For example, some organizers found in the prior art are often bulky and cannot easily be moved around a room. Other organizers that are portable do not allow for the storage and/or display of shoes, clothing, and other miscellaneous items all in one unit. Moreover, many organizers are limited in that only one side of the organizer allows access to the apparel stored and/or displayed therein. Additionally, the bulk of prior art organizers have dimensions and/or properties that make them ill-suited for use with children's shoes, clothing, and items, such as toys.

Thus, there is a need for a portable storage apparatus that can store and display clothing, shoes, and other items (particularly those belonging to a child) in a manner that allows at least some of the apparel to be accessible from more than one side of the organizer apparatus. Moreover, the portable organizer apparatus should be sturdy, space-efficient, and relatively small.

SUMMARY

One feature provides a portable organizer apparatus comprising a frame, a hanger rod coupled to the frame and adapted to receive one or more garment hangers, a shoe shelf coupled to the frame, where the shoe shelf has a first surface and a second surface each adapted to support shoes, and a drawer coupled to the frame, where the drawer has a cavity adapted to receive and store at least one of toys, books, or clothing. According to one embodiment, the first and second surfaces of the shoe shelf are angled with respect to each other at an angle $\alpha$ that is greater than or equal to 45 degrees and less than or equal to 165 degrees. According to another embodiment, the first and second surfaces of the shoe shelf are adjustable relative to one another so that the angle $\alpha$ may be changed. According to yet another embodiment, the hanger rod and the shoe shelf are removeably coupled to the frame.

According to one embodiment, the frame comprises a first side support and a second side support, wherein a first surface of the first side support is coupled to a first end of the hanger rod and a first surface of the second side support is coupled to a second, opposing end of the hanger rod. According to another embodiment, a second surface of the first side support is coupled to a first end of the shoe shelf, and a second surface of the second side support is coupled to a second, opposing end of the shoe shelf. According to yet another embodiment, a front surface and a rear surface of the drawer are orthogonal to the second surfaces of the first and second side supports, and the first and second surfaces of the shoe shelf are also orthogonal to the second surfaces of the first and second side supports. According to another embodiment, the first side support comprises a first upper side support and a first lower side support, and the second side support comprises a second upper side support and a second lower side support, the first upper side support coupled to the first end of the hanger rod and the second upper side support coupled to the second end of the hanger rod.

According to one embodiment, the first lower side support is coupled to a first end of the shoe shelf and the second lower side support is coupled to a second, opposing end of the shoe shelf. According to another embodiment, the first and second upper side supports have a height $h_2$ and the first and second lower side supports have a height $h_3$, and a ratio of the height $h_2$ to the height $h_3$ is greater than 1.2 and less than 3.0. According to yet another embodiment, the apparatus has a height $h_1$ that is less than or equal to 44 inches, a width w that is less than or equal to 50 inches, and a depth $d_1$ that is less than or equal to 24 inches. According to another embodiment, the hanger rod is positioned closer to a first end of the apparatus than the shoe shelf, and the shoe shelf is positioned closer to the first end of the apparatus than the drawer.

According to one embodiment, the shoe shelf includes a first member and a second member, the first member having the first surface of the shoe shelf and the second member having the second surface of the shoe shelf, the first surface of the shoe shelf having a normal vector $N_1$ that points away from a normal vector $N_2$ associated with the second surface of the shoe shelf. According to another embodiment, the apparatus further comprises a plurality of wheels coupled to the bottom of the frame. According to yet another embodiment, the first and second surfaces of the shoe shelf are at an angle $\beta$ relative to a ground plane, where the angle $\beta$ is greater than or equal to 7.5 degrees and less than or equal to 67.5 degrees.

According to one embodiment, the first and second surfaces of the shoe shelf are adapted to display a plurality of shoes from both a front side of the apparatus and a rear, opposing side of the apparatus. According to another embodiment, the drawer is a two-way drawer that can be opened from two, opposing sides of the apparatus. According to yet another embodiment, the two-way drawer resides on a plurality of pass-through tracks that enable the two-way drawer to be opened from a front side of the apparatus and a rear side of the apparatus.

Another feature provides a portable storage apparatus kit comprising a plurality of portable storage apparatus components packaged together for sale to consumers, and wherein the portable storage apparatus components comprises a frame, a hanger rod adapted to couple to the frame and receive one or more garment hangers, a shoe shelf adapted to couple to the frame, the shoe shelf having a first surface and a second surface each adapted to support shoes, and a drawer adapted to couple to the frame, the drawer having a cavity adapted to receive and store objects.

Another feature provides a method of manufacturing a portable storage apparatus, where the method comprises providing a frame, coupling a hanger rod to the frame, the hanger rod adapted to receive one or more garment hangers, coupling a shoe shelf to the frame, the shoe shelf having a first surface and a second surface each adapted to support shoes, and coupling a drawer to the frame, the drawer having a cavity adapted to receive and store objects.

DETAILED DESCRIPTION

In the following description numerous specific details may be set forth in order to provide a thorough understanding of the invention. However, one skilled in the art would recognize that the invention might be practiced without these specific details. In other instances, well known methods, procedures, and/or components have not been described in detail so as not to unnecessarily obscure aspects of the invention.

In the following description, certain terminology is used to describe certain features of one or more embodiments of the invention. For example, the term "exemplary" as used herein is defined as serving as one example or illustration. As used herein, the term "ground plane" refers to a plane parallel to the ground upon which the portable storage apparatus is supported on.

Overview

A portable storage apparatus that comprises a frame, a hanger rod, a shoe shelf, and a drawer is described herein according to various embodiments. The hanger rod, the shoe shelf, and the drawer are coupled to the frame. The hanger rod is adapted to receive and support garment hangers and garments. The shoe shelf is adapted to receive and support shoes. The drawer includes a cavity that may receive and store a plurality of objects, including clothing, toys, and books. The shoe shelf may include two surfaces that are angled with respect to each other and the ground. The drawer may be either a one-way drawer that opens from the front side of the apparatus or a two-way drawer that opens from the front and the rear of the apparatus. The apparatus may further comprise a plurality of wheels that are attached to the bottom of the apparatus to allow for easier mobility.

Portable Storage Apparatus

Figure 1:
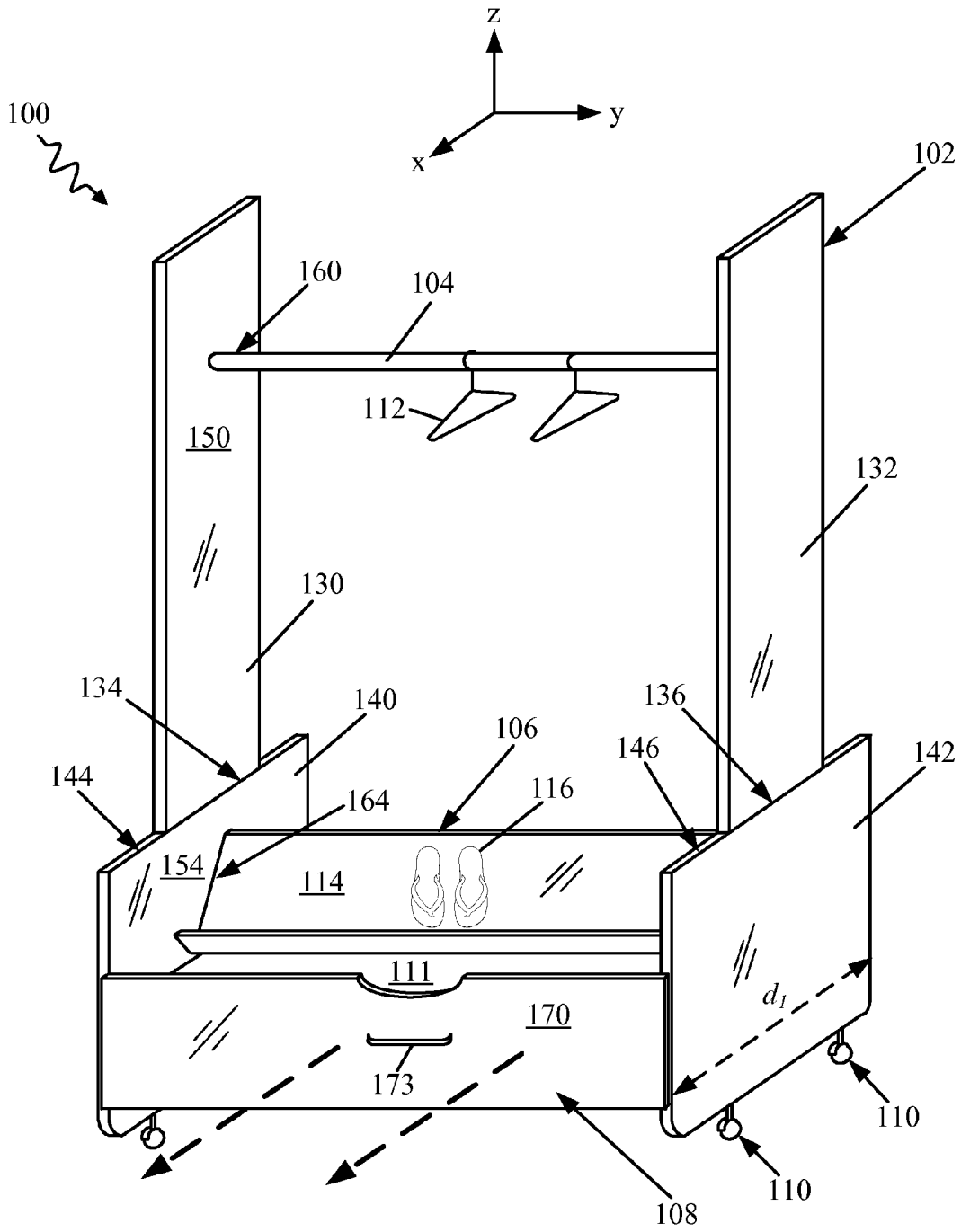
FIG. 1 illustrates a front, perspective view of a portable storage apparatus.

FIG. 1 illustrates a front, perspective view of a portable storage apparatus 100 (e.g., also referred to herein as an "organizer") according to one embodiment. The apparatus 100 may be, for example, a children's clothing and shoe organizer that helps store and display apparel, shoes, and other objects such as books and toys. The apparatus 100 may comprise a frame 102, a hanger rod 104, a shoe shelf 106, a drawer 108, and a plurality of wheels 110. The frame 102 may be made of any rigid material, such as, but not limited to, metal, wood, and/or plastic. The hanger rod 104 may also be made of a rigid material, such as metal, wood, and/or plastic, and is adapted to allow a plurality of hangers 112 to couple to it for hanging garments. The drawer 108 is retractable and may be pulled open (see dashed arrows in FIG. 1) and pushed closed for easier access to the drawer's 108 storage cavity 111. The drawer 108 may be used to store a variety of different objects, such as, but not limited to, clothing, books, toys, media, electronics, etc.

The plurality of wheels 110 (e.g., four wheels) may be positioned on the underside of the apparatus 100 to allow the apparatus 100 to be easily moved around a room with less effort than having to lift the apparatus 100. A wheel 110 may be located at each bottom corner of the apparatus as shown in FIG. 1. Moreover, the wheels 110 may include a locking mechanism (not shown) that prevents the wheels 110 from rolling once the wheel locking mechanism is engaged.

Figure 2:
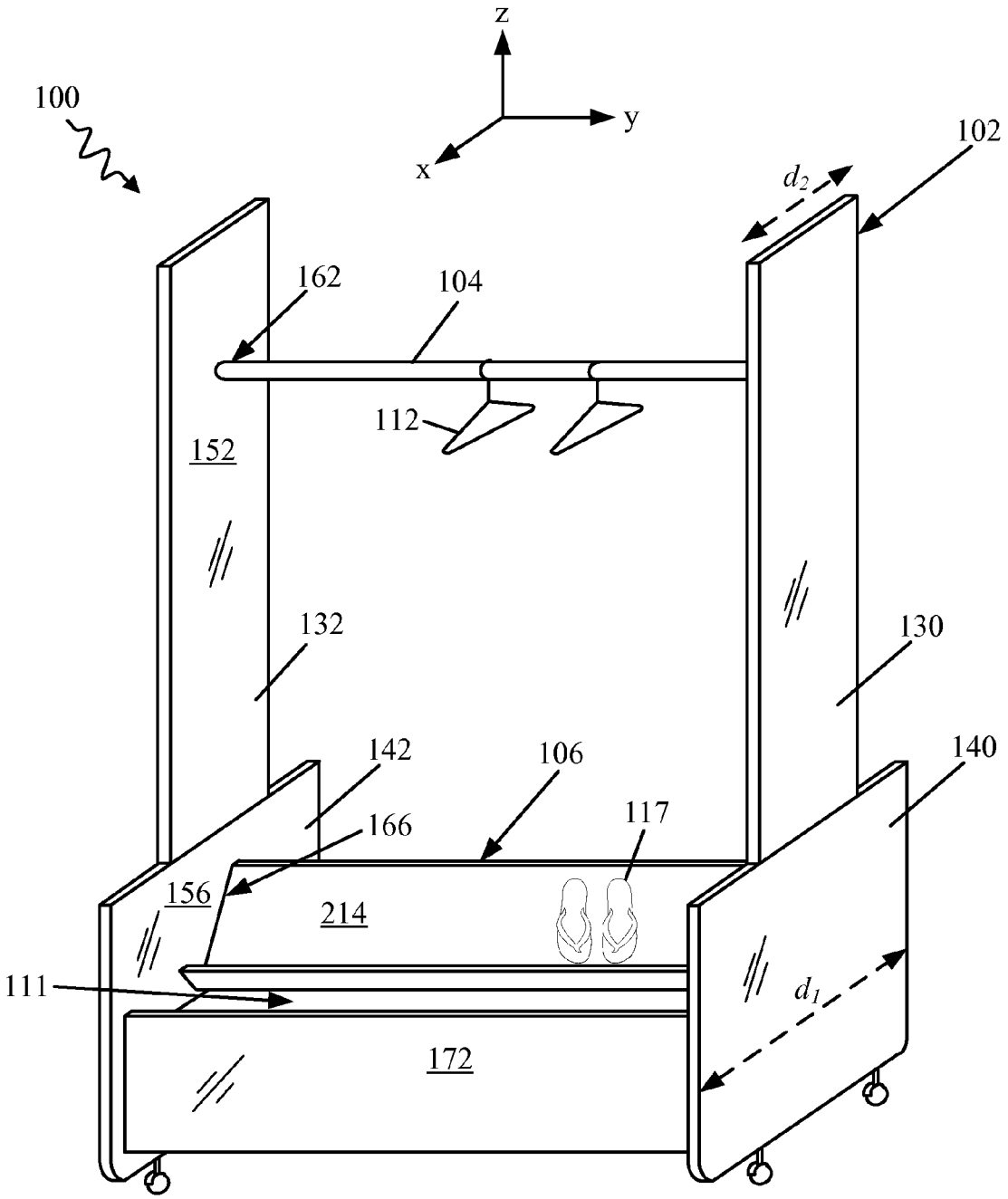
FIG. 2 illustrates a rear, perspective view of a portable storage apparatus.

FIG. 2 illustrates a rear, perspective view of the portable storage apparatus 100 according to one embodiment. Referring to FIGS. 1 and 2, the hanger rod 104 is positioned such that it is above the shoe shelf 106, which is in turn positioned such that it is above the drawer 108. The shoe shelf 106 includes a first surface 114 and a second surface 214 that are adapted to support one or more pairs of shoes. The first and second surfaces 114, 214 may be angled with respect to the x-y plane (x-y plane is parallel to the ground), and thus they may not be parallel to the ground. The surfaces 114, 214 are also angled with respect to each other. One or more shoes 116, 117 may be placed on top of the first and second surfaces 114, 214 as shown in FIGS. 1 and 2. In this fashion, the first and second surfaces 114, 214 store and display one or more pairs of shoes 116, 117 on each side (i.e., front and rear) of the apparatus 100, which makes seeing, retrieving, and accessing the shoes 116, 117 easier. Moreover, the angled surfaces 114, 214 minimize the depth $d_1$ of the apparatus 100 necessary to support the shoes 116, 117.

With further reference to FIGS. 1 and 2, the frame 102 may comprise a first upper side support 130, a second upper side support 132, a first lower side support 140, and a second lower side support 142. According to embodiment illustrated, the first upper side support 130 and the first lower side support 140 are separate pieces that are fastened together. For example, a bottom edge (e.g., first edge) 134 of the first upper side support 130 may be fastened (e.g., glued, nailed, screwed, etc.) to a top edge (e.g., first edge) 144 of the first lower side support 140. According to another embodiment, the first upper side support 130 and the first lower side support 140 may be part of a single first side support member (i.e., not individual pieces fastened together).

Similarly, the second upper side support 132 and the second lower side support 142 may be separate pieces that are fastened together as shown in FIGS. 1 and 2. For example, a bottom edge (e.g., first edge) 136 of the second upper side support 132 may be fastened (e.g., glued, nailed, screwed, etc.) to a top edge (e.g., first edge) 146 of the second lower side support 142. According to another embodiment, the second upper side support 132 and the second lower side support 142 may be part of a single second side support member (i.e., not individual pieces fastened together).

With further reference to FIGS. 1 and 2, the first upper side support 130 has a first surface 150 that faces the second upper side support's first surface 152. A first end 160 of the hanger rod 104 couples to the first surface 150 of the first upper side support 130 (see FIG. 1), and a second, opposite end 162 of the hanger rod 104 couples to the first surface 152 of the second upper side support 132 (see FIG. 2). In one embodiment, the first and second ends 160, 162 of the hanger rod 104 are removeably coupled to the first and second upper side supports 130, 132.

The first lower side support 140 has a first surface 154 that faces the second lower side support's 142 first surface 156. A first end 164 of the shoe shelf 106 couples to the first surface 154 of the first lower side support 140 (see FIG. 1), and a second, opposite end 166 of the shoe shelf 106 couples to the first surface 156 of the second lower side support 142 (see FIG. 2). In one embodiment, the first and second ends 164, 166 of the shoe shelf 106 are removeably coupled to the first and second lower side supports 140, 142.

Figure 3:
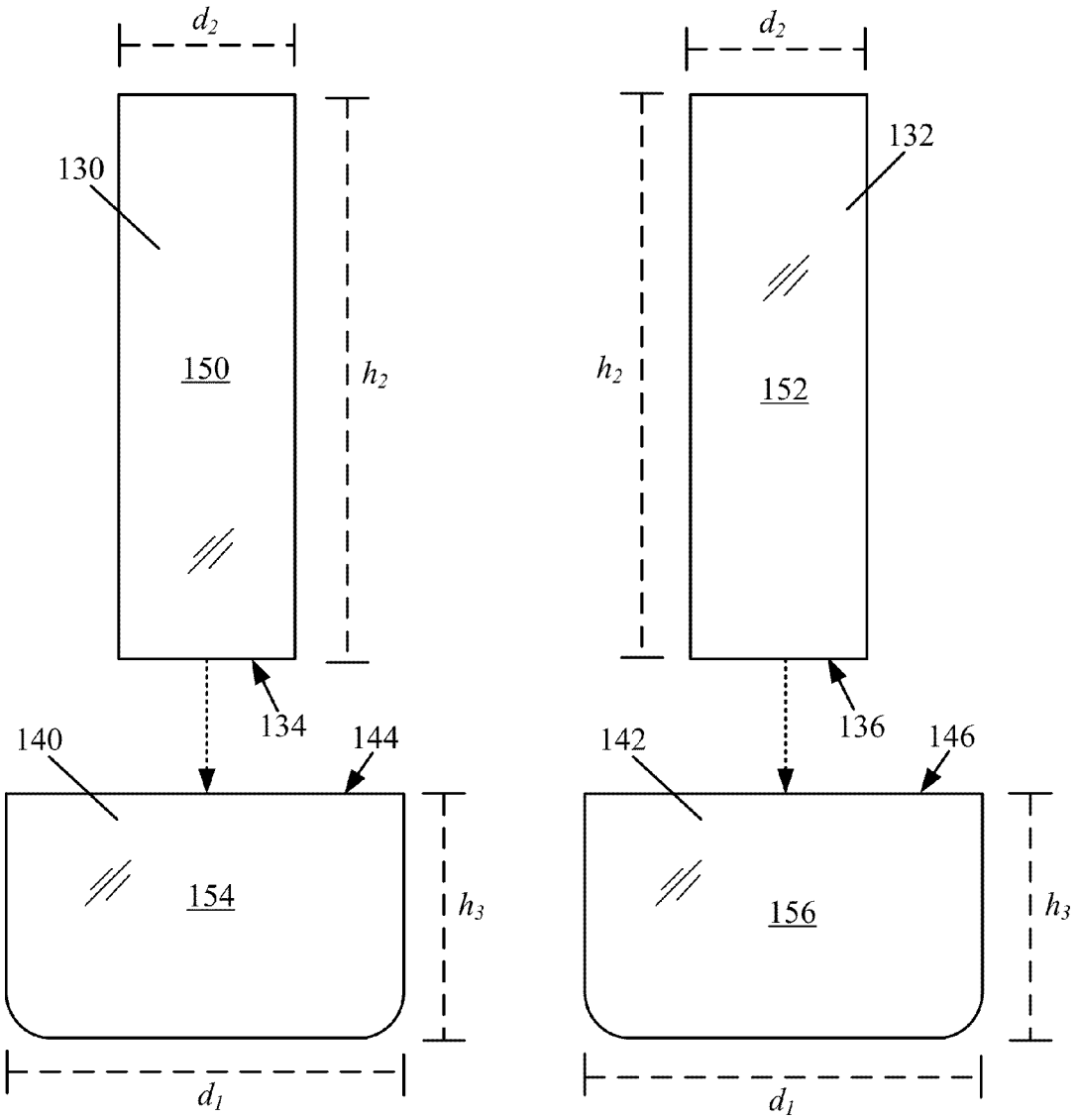
FIG. 3 illustrates a side view of first and second upper side supports and first and second lower side supports.

FIG. 3 illustrates a side view of the first and second upper side supports 130, 132, and the first and second lower side supports 140, 142. Specifically, FIG. 3 shows the embodiment where the first upper side support 130, the second upper side support 132, the first lower side support 140, and the second lower side support 142 are separate pieces. As noted above, the upper side support 130, 132 and the lower side supports 140, 142 may be separate components that can be joined/fastened together as shown by the dashed arrows in FIG. 3. The bottom edges 134, 136 of the upper side supports 130, 132 may be fastened to the upper edges 144, 146 of the lower side supports 140, 142. FIG. 3 also shows several surfaces 150, 152, 154, 156 of the upper and lower side supports 130, 132, 140, 142.

Figure 4:
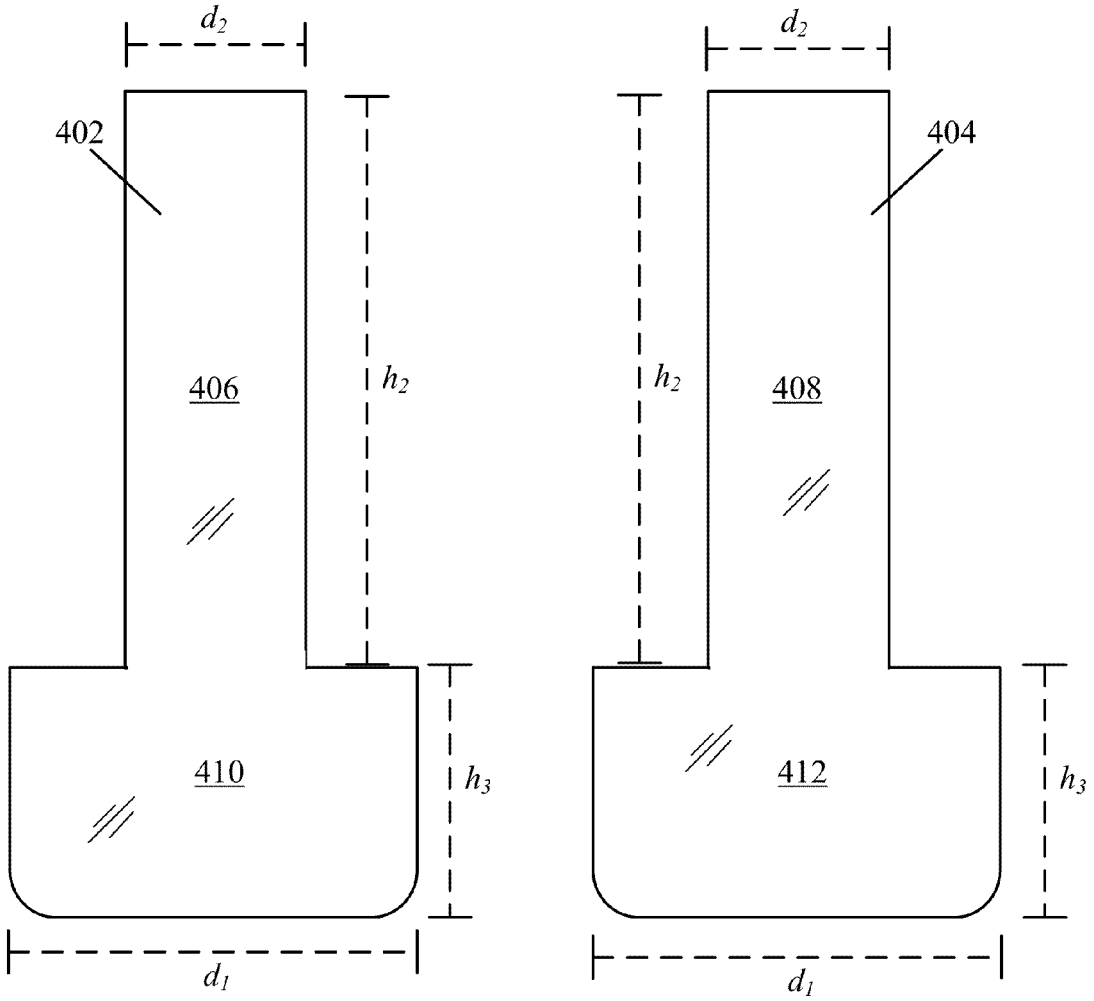
FIG. 4 illustrates a side view of a first side support and a second side support.

FIG. 4 illustrates a side view of a first side support 402 and a second side support 404 according to another embodiment. Specifically, FIG. 4 shows the embodiment where the first upper side support 130 and the first lower side support 140 is one composite first side support 402. Similarly, the second upper side support 132 and the second lower side support 142 may be one individual second side support 404. The first and second side supports 402, 404 shown are planar. The first side support 402 may have a first surface 406 that is similar to the first surface 150 of the first upper side support 130 in that it couples to the first end 160 of the hanger rod 104. The second side support 404 may have a first surface 408 that is similar to the first surface 152 of the second upper side support 132 in that it couples to the second end 162 of the hanger rod 104. The first side support 402 may have a second surface 410 that is similar to the first surface 154 of the first lower side support 140 in that it couples to the first end 164 of the shoe shelf 106. The second side support 404 may have a second surface 412 that is similar to the first surface 156 of the second lower side support 142 in that it couples to the second end 166 of the shoe shelf 106. The first and second side supports 402, 404 may have any structure not limited to that shown in FIG. 4.

Figure 5:
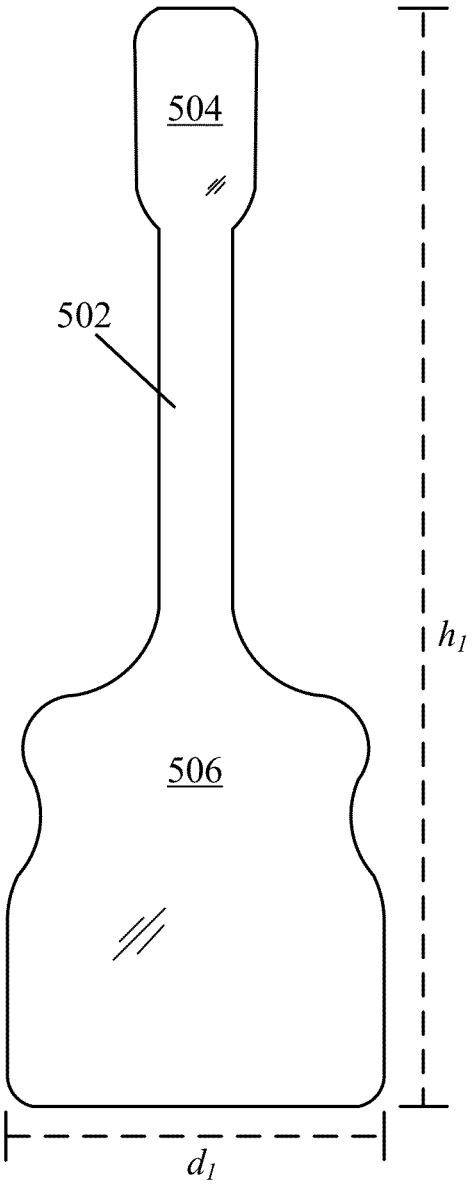
FIG. 5 illustrates a side view of a first and/or second side support.

FIG. 5 illustrates a side view of a first and/or second side support 502 according to another embodiment. As shown the side supports to the apparatus 100 may be any shape, including aesthetically pleasing shapes, such as, but not limited to a musical instruments (guitar shown), animals, and other shapes, such as abstract shapes. The side support 502 may have a first surface 504 that is similar to the first and second surfaces 150, 152 of the first and second upper side supports 130, 132 (see FIGS. 1 and 2) in that it couples to the ends 160, 162 of the hanger rod 104. The side support 502 may have a second surface 506 that is similar to the first and second surfaces 154, 156 of the first and second lower side supports 140, 142 in that it couples to the ends 164, 166 of the shoe shelf 106.

Figure 7:
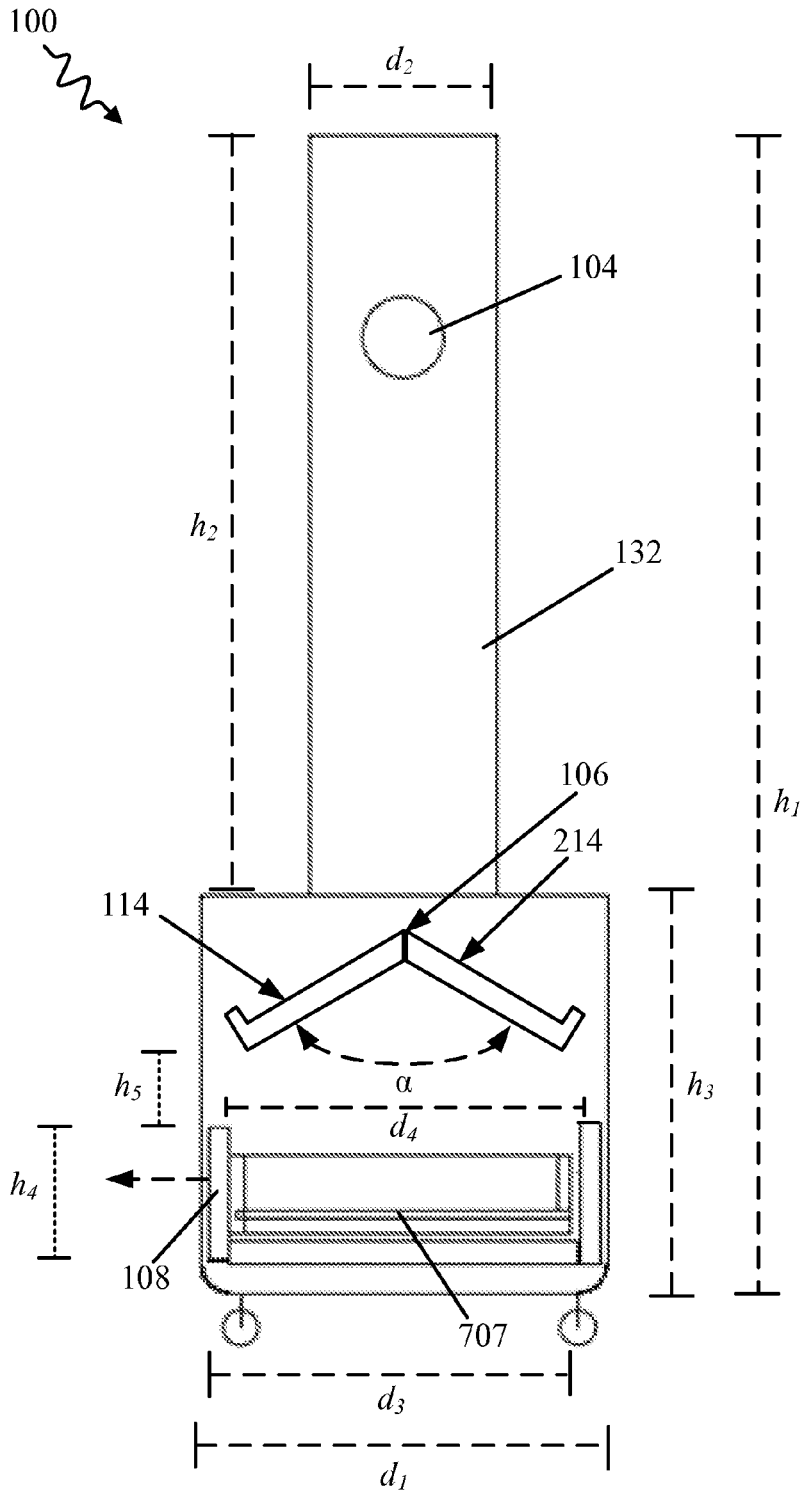
FIG. 7 illustrates a cross-sectional side view of a portable storable apparatus.

Referring back to FIGS. 1 and 2, the drawer 108 includes a front surface 170 and a rear surface 172 that are orthogonal to the first surfaces 154, 156 of the first and second lower side supports 140, 142, and the second surfaces 410, 412, 506 of the first and second side supports 402, 404, 502. The front surface 170 may include a handle 173 that allows the drawer 108 to be pulled out as shown by the dashed arrows. In the embodiment shown in FIG. 1, the drawer 108 may be pulled open from one side (the front side) of the apparatus 100. According to one example, the drawer 108 may slide open and close on a track (not shown in FIGS. 1 and 2), and according to another example, the drawer 108 may be trackless. The track may be a typical wheeled, two-piece metal slide where one metal slide piece of each track attaches to the first surfaces 154, 156 of the lower side supports 140, 142 and the other metal slide piece attaches to a side of the drawer 108. (An example of such a track 707 is shown in FIG. 7). In the example shown in FIGS. 1 and 2, a track used with the drawer 108 would be a one-way track since the drawer 108 may be pulled open from the front side (see FIG. 1) of the apparatus 100 but not the rear side (see FIG. 2).

The apparatus 100 may have a single drawer 108 that positioned in between the shoe shelf 106 and the wheels 110 as shown in FIGS. 1 and 2. That is, the shoe shelf 106 is directly above the drawer 108, and the wheels 110 are below (i.e., closer to the ground) the drawer 108. The drawer 108 may also be directly supported by the lower side supports 140, 142. In another embodiment, the apparatus 100 may have a plurality of drawers. For example, two drawers similar to the drawer 108 shown in FIGS. 1 and 2 may be stacked on top of each other. (See FIG. 11).

Figure 6:
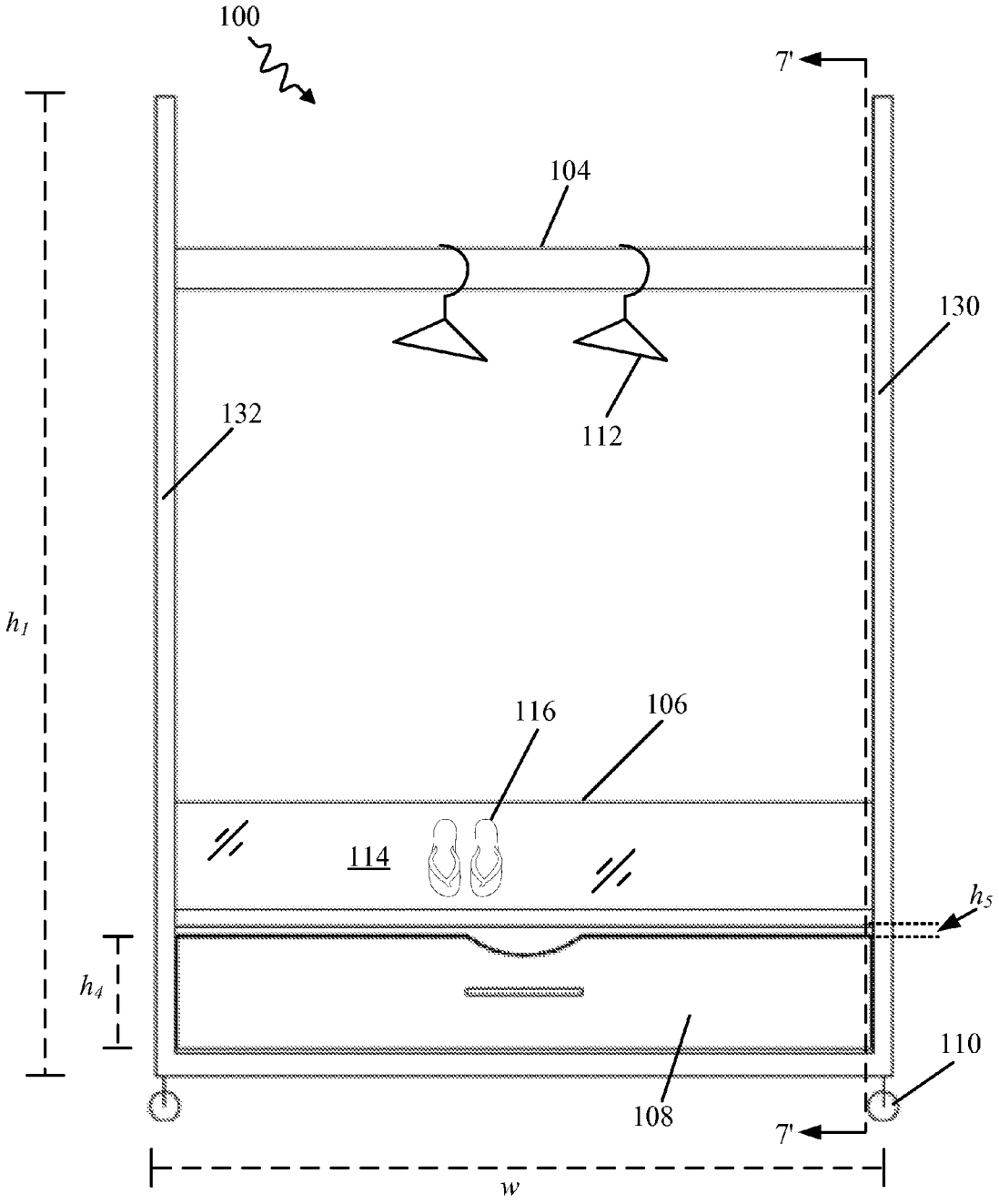
FIG. 6 illustrates a front view of a storage apparatus.

FIG. 6 illustrates a front view of the storage apparatus 100 according to one embodiment. FIG. 7 illustrates a cross-sectional side view of the apparatus 100 taken along the line 7'-7' (see FIG. 6). Referring to FIGS. 3-7, the apparatus 100 has a total height $h_1$ excluding the wheels 110. That is, the height of each upper side support 130, 132 plus the height of each lower side support 140, 142 is equal to $h_1$. The height of just the upper side supports 130, 132 is $h_2$, while the height of just the lower side supports 140, 142 is $h_3$. Thus, $h_1=h_2+h_3$. According to one embodiment, the height $h_1$ is less than or equal to 36 inches. According to another embodiment, the height $h_1$ is less than or equal to 42 inches. According to yet another embodiment, the height $h_1$ is less than or equal to 48, 54, 60, 66, 72, or 80 inches. According to one embodiment, the height $h_2$ is less than or equal to 24 inches. According to another embodiment, the height $h_2$ is less than or equal to 28 inches. According to yet another embodiment, the height $h_2$ is less than or equal to 36, 40, 44, 48, 52, 54, or 60 inches. According to one embodiment, the ratio of the height $h_2$ to the height $h_3$ (i.e., $h_2/h_3$) is between 1.2 and 3.0 According to another embodiment, the ratio of the height $h_2$ to the height $h_3$ (i.e., $h_2/h_3$) is between 0.8 and 1.2.

Referring to FIG. 6, the storage apparatus 100 has a width equal to w. The width w may be, for example, approximately 48 inches. According to one embodiment, the width w may range between 24 and 48 inches. According to another embodiment, the width w may range between 48 and 96 inches. Referring to FIGS. 1-5 and 7, the storage apparatus 100 has a maximum depth $d_1$, which is equal to the width $d_1$ of the lower side supports 140, 142 and the side supports 402, 404, 502. The upper side supports 130, 132 and the side supports 406, 408 may have a second width $d_2$ near the top of the side support. According to one example, the maximum depth $d_1$ may be less than or equal to 12, 14, 16, 18, 20, 22, 24, 26, or 28 inches. Referring to FIGS. 6 and 7, the drawer 108 has a height $h_4$ and a depth $d_3$, and the shoe shelf 106 has a depth $d_4$. The shoe shelf is positioned a distance $h_5$ above the drawer 108.

Referring to FIG. 7, the shoe shelf 106 has two surfaces 114, 214 that are angled with respect to one another so that shoes stored thereon may be positioned at an angle (relative to the ground) to minimize the necessary depth $d_1$ of the apparatus 100. The first and second surfaces 114, 214 may also be orthogonal to the first surfaces 154, 156 of the first and second lower side supports 140, 142, and the second surfaces 410, 412, 506 of the first and second side supports 402, 404, 502. In one embodiment, the surfaces 114, 214 may be positioned between a 45 degree to 165 degree angle α with respect to one another as shown in FIG. 7. According to another embodiment, the positioning and angle of the two surfaces 114, 214 is adjustable so that the angle α may be increased or decreased. The adjustability of the angling of these two surfaces 114, 214 may allow a to change from between 45 degrees to 165 degrees.

Figure 8:
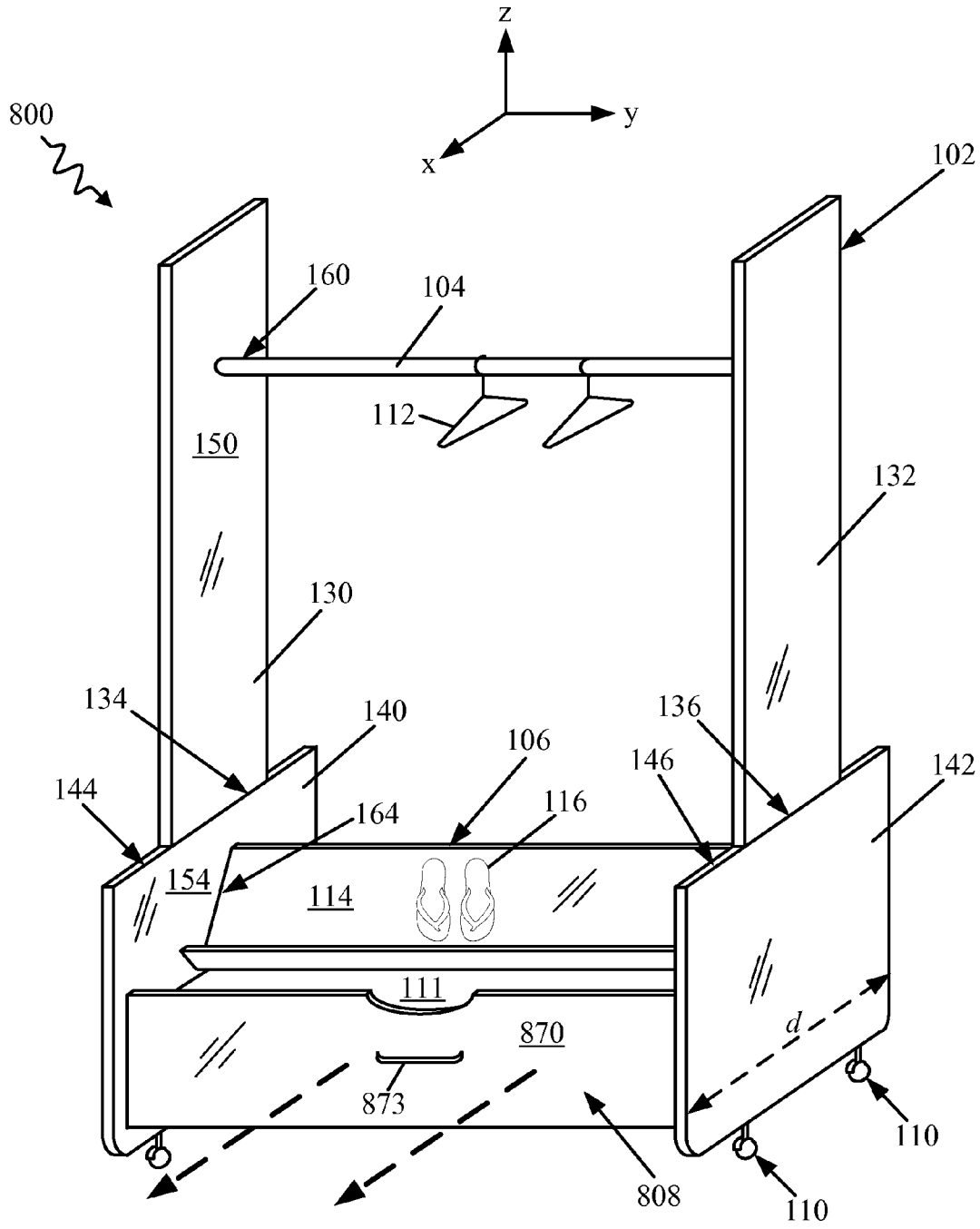
FIG. 8 illustrates a front, perspective view of another portable storage apparatus.
Figure 9:
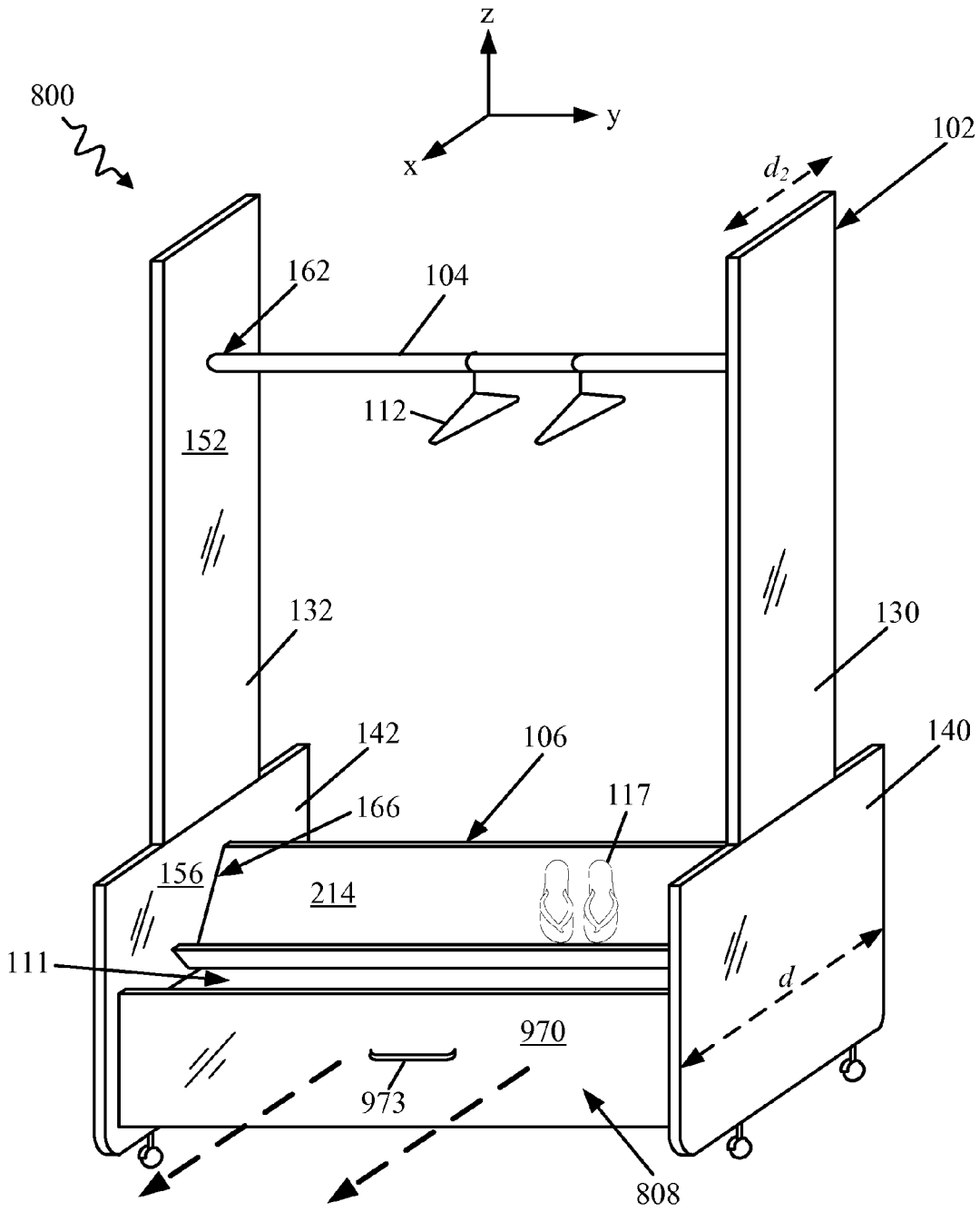
FIG. 9 illustrates a rear, perspective view of another portable storage apparatus.
Figure 10:
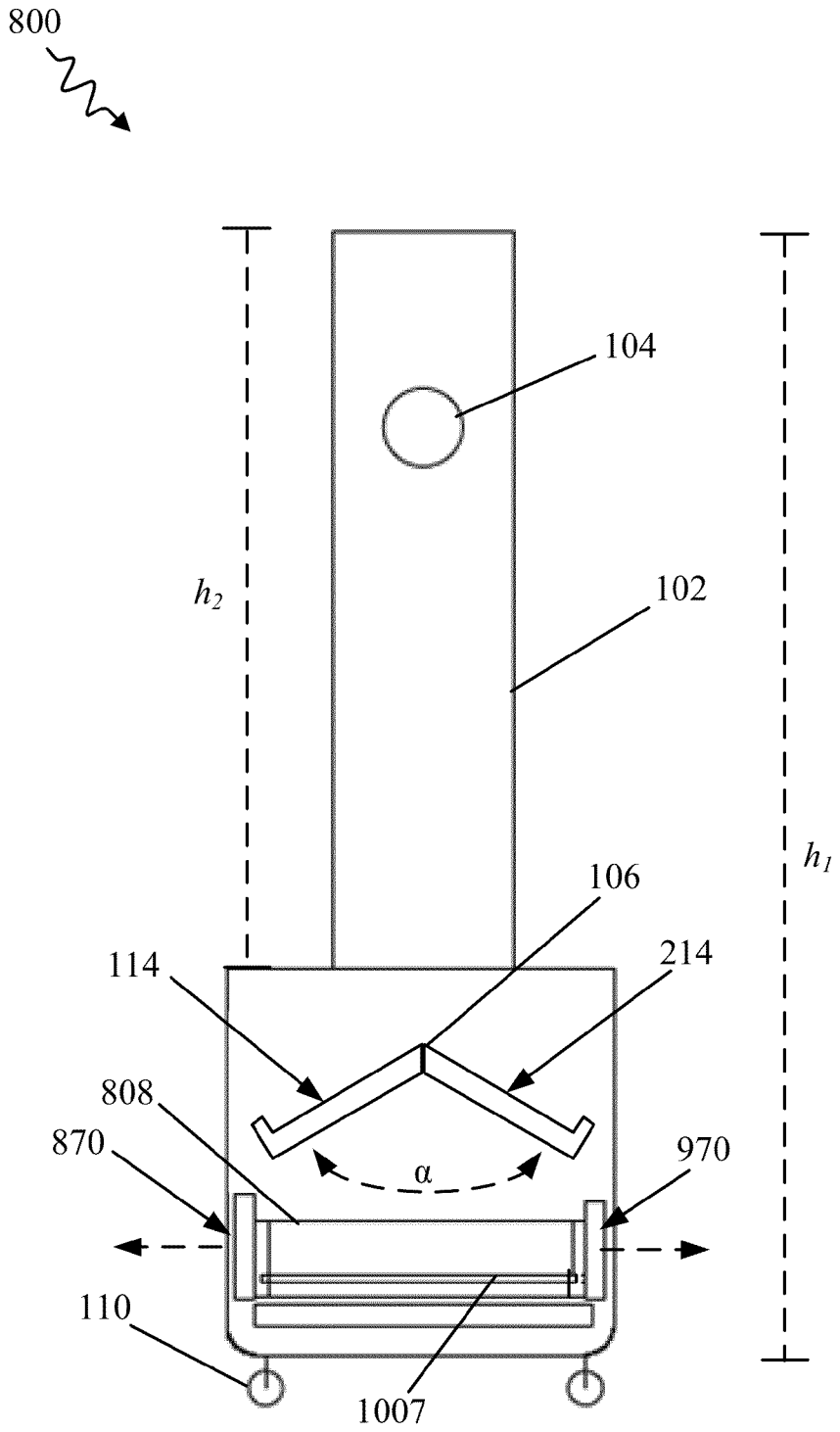
FIG. 10 illustrates a side view of another portable storage apparatus.

FIGS. 8-10 illustrate a portable storage apparatus 800 according to another embodiment. Specifically, FIG. 8 illustrates a front, perspective view of the portable storage apparatus 800. FIG. 9 illustrates a rear, perspective view of the apparatus 800, and FIG. 10 illustrates a side view of the apparatus. The apparatus 800 may be substantially identical to the apparatus 100 shown in FIGS. 1-7 except that the apparatus 800 notably features a drawer 808 (e.g., two-way drawer) that may be opened from both the front side (see FIG. 8) and the rear side (See FIG. 9) of the storage apparatus 800 (as indicated by the dashed arrows).

Referring to FIG. 8, the two-way drawer 808 may include a front surface 870 with a front handle 873 that allows the drawer 808 to be pulled open from the front side of the apparatus 800 (as shown by the dashed arrows). Referring to FIG. 9, the two-way drawer 808 may include a rear surface 970 with a rear handle 973 that allows the drawer 808 to be pulled open from the rear side of the apparatus 800 (as shown by the dashed arrows). The two-way drawer 808 may reside on "pass-through drawer" tracks (see e.g., track 1007 in FIG. 10) that allow for it to be pulled/pushed open and closed from both sides.

The drawer 808 shown in FIGS. 8-10 has the advantage that the contents of the drawer 808 may be accessed from either side of the apparatus 800. Thus, if the apparatus 800 is positioned in such a way so that neither its front or rear sides are obstructed (e.g., by a wall) then a user may take advantage of the drawer's 808 bidirectional accessibility by pulling open the drawer 808 from either the front side or the rear side of the apparatus 800. FIG. 10 further illustrates how the drawer 808 may be pushed and/or pulled open from either side (see dashed arrows).

Figure 11:
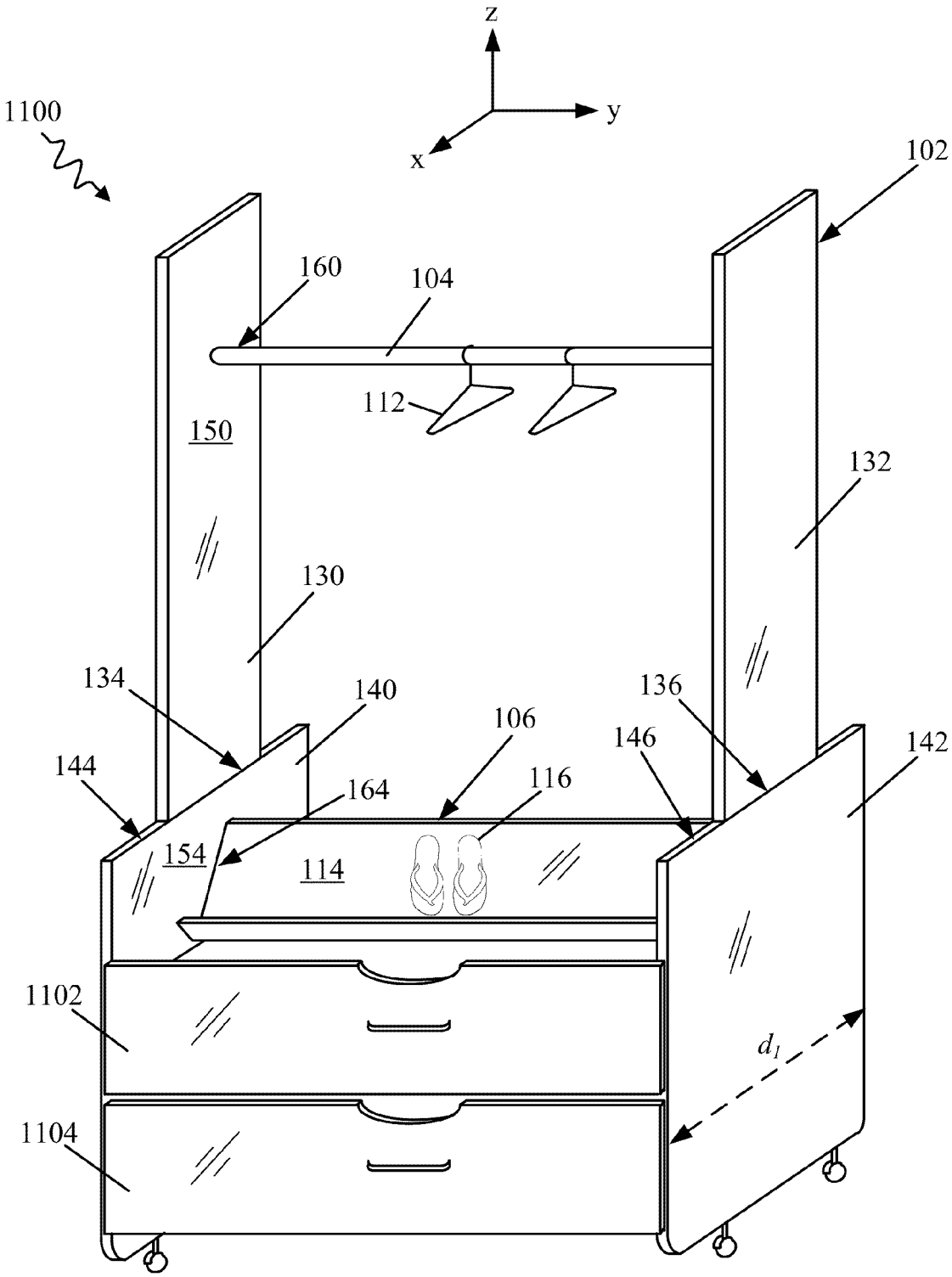
FIG. 11 illustrates a front, perspective view of a portable storage apparatus.

FIG. 11 illustrates a front, perspective view of a portable storage apparatus 1100 according to another embodiment. The apparatus 1100 is identical to the apparatus 100 or the apparatus 800 shown in FIGS. 1 and 8, except that the apparatus 1100 of FIG. 11 includes two drawers 1102, 1104 instead of a single drawer 108, 808. The two drawers 1102, 1104 may be stacked on top of each other as shown. The drawers 1102, 1104 may be one-way drawers (i.e., open from the front side only) like the drawer 108 of FIG. 1, or two-way drawers like the drawer 808 of FIG. 8. According to other embodiments, the apparatus 1100 may have any number of drawers stacked on top of each other.

Figure 12:
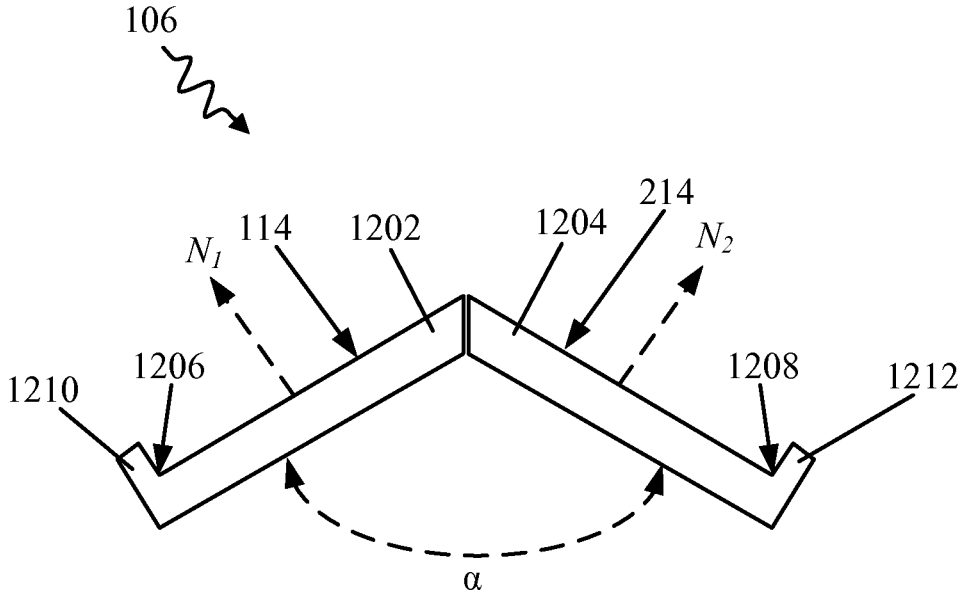
FIGS. 12 and 13 illustrate a cross-sectional side view of a shoe shelf.

FIG. 12 illustrates a cross-sectional side view of the shoe shelf 106 taken along the line 7'-7' (see FIG. 6). The shoe shelf 106 may be comprised of a first member 1202 that includes the first surface 114, and a second member 1204 that includes the second surface 214. As described above, the first and second surfaces 114, 214 are adapted to receive and support one or more pairs of shoes. The first member's first surface 114 has normal vector N1 that points away from a normal vector N2 associated with the second member's second surface 214. Thus, the shoe shelf's first surface 114 faces away from the second surface 214. The surfaces 114, 214 may be oriented such that the normal vectors N1 and N2 are at an angle α with respect to one another where α may be between 45 and 165 degrees. The shoe shelf 106 also may include a first lateral support member 1210 coupled to a first end 1206 of the first member 1202 and a second lateral support member 1212 coupled to a first end 1208 of the second member 1204. The first and second lateral support members 1210, 1212 are adapted to support the edges of shoes 116, 117 (see e.g., FIGS. 8 and 9) while the first and second surfaces 114, 214 are adapted to support the outsoles of shoes.

Figure 13:
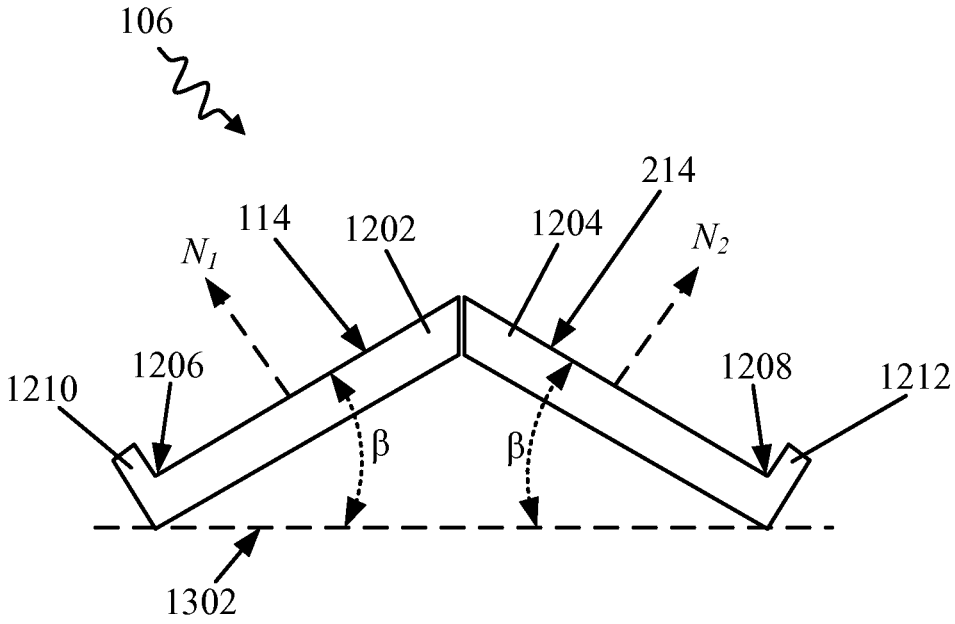

FIG. 13 also illustrates a cross-sectional side view of the shoe shelf 106 taken along the line 7'-7' (see FIG. 6). Specifically, it shows how the first and second surfaces 114, 214 of the shoe shelf 106 are angled with respect to the ground plane 1302. The first and second surfaces 114, 214 may be at an angle β relative to the ground plane 1302, where β is greater than or equal to 7.5 degrees and less than or equal to 67.5 degrees. Thus according to one embodiment, the first and second surfaces 114, 214 of the shoe shelf 106 are not parallel to the ground.

Figure 14:
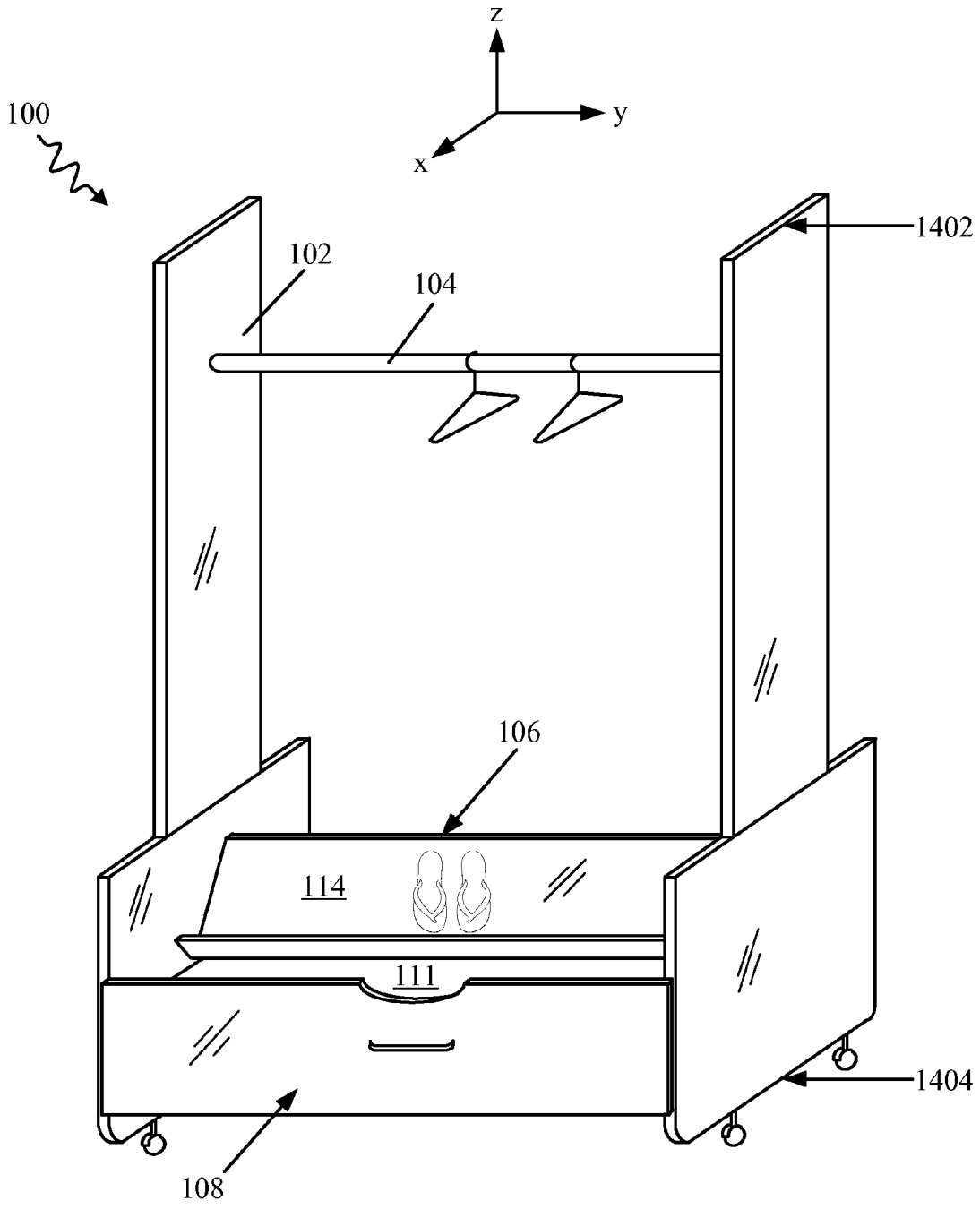
FIG. 14 illustrates a portable storage apparatus.

FIG. 14 illustrates the portable storage apparatus 100. In particular, the apparatus 100 includes a top end 1402 (also referred to as a "first end") and a bottom end 1404 (also referred to as a "second end"). The components 104, 106, 108 of the apparatus 100 may be arranged such that the hanger rod 104 is closer to the first end 1402 than the shoe shelf 106, and the shoe shelf 106 is closer to the first end 1402 than the drawer 108. Accordingly, the drawer 108 is closer to the second end 1404 than the shoe shelf 106, and the shoe shelf 106 is closer to the second end 1404 than the hanger rod 104. Such an arrangement of the components 104, 106, 108 may offer a user a better unobstructed view of the shoes than if the shoe shelf 106 was, for example, positioned below the drawer 108 (i.e., shoe shelf 106 closer to the second end 1404 than the drawer 108). Moreover, positioning the hanger rod 104 closer to the first end 1402 of the apparatus 100 may avoid soiling any garments hanging from the rod 104 against the ground.

Portable Storage Apparatus Kit

Figure 15:
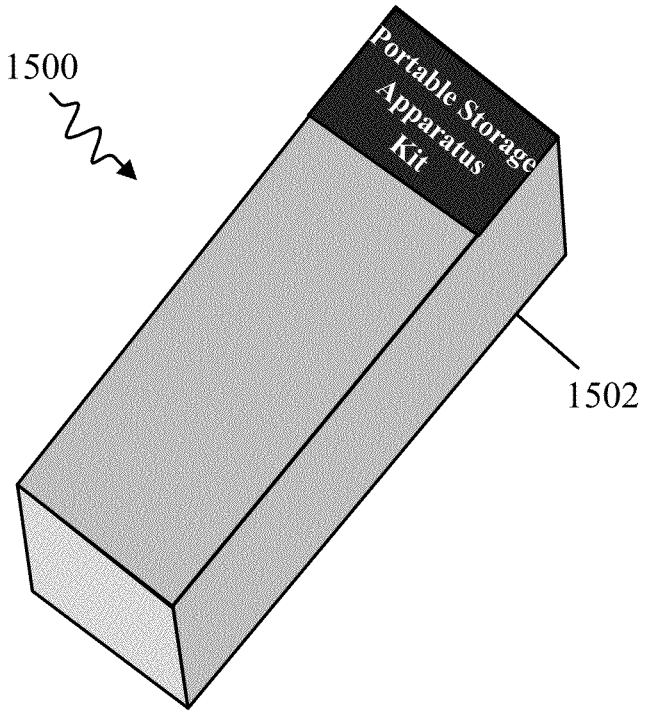
FIG. 15 illustrates a portable storage apparatus kit.

FIG. 15 illustrates a portable storage apparatus kit 1500 that houses one or more portable storage apparatus components in a packaging 1502 for sale (e.g., retail sale) to consumers. The portable storage apparatus components of the kit 1500 may include, a frame that includes a first and second side supports 402, 404, a hanger rod 104, a shoe shelf 106, a drawer 108, a plurality of wheels 110, and a plurality of fasteners and/or drawer tracks to couple the components to one another to assemble the portable storage apparatus. Generally, the kit 1500 may include any of the elements shown in FIGS. 1-14.

Method of Manufacturing a Portable Storage Apparatus

Figure 16:
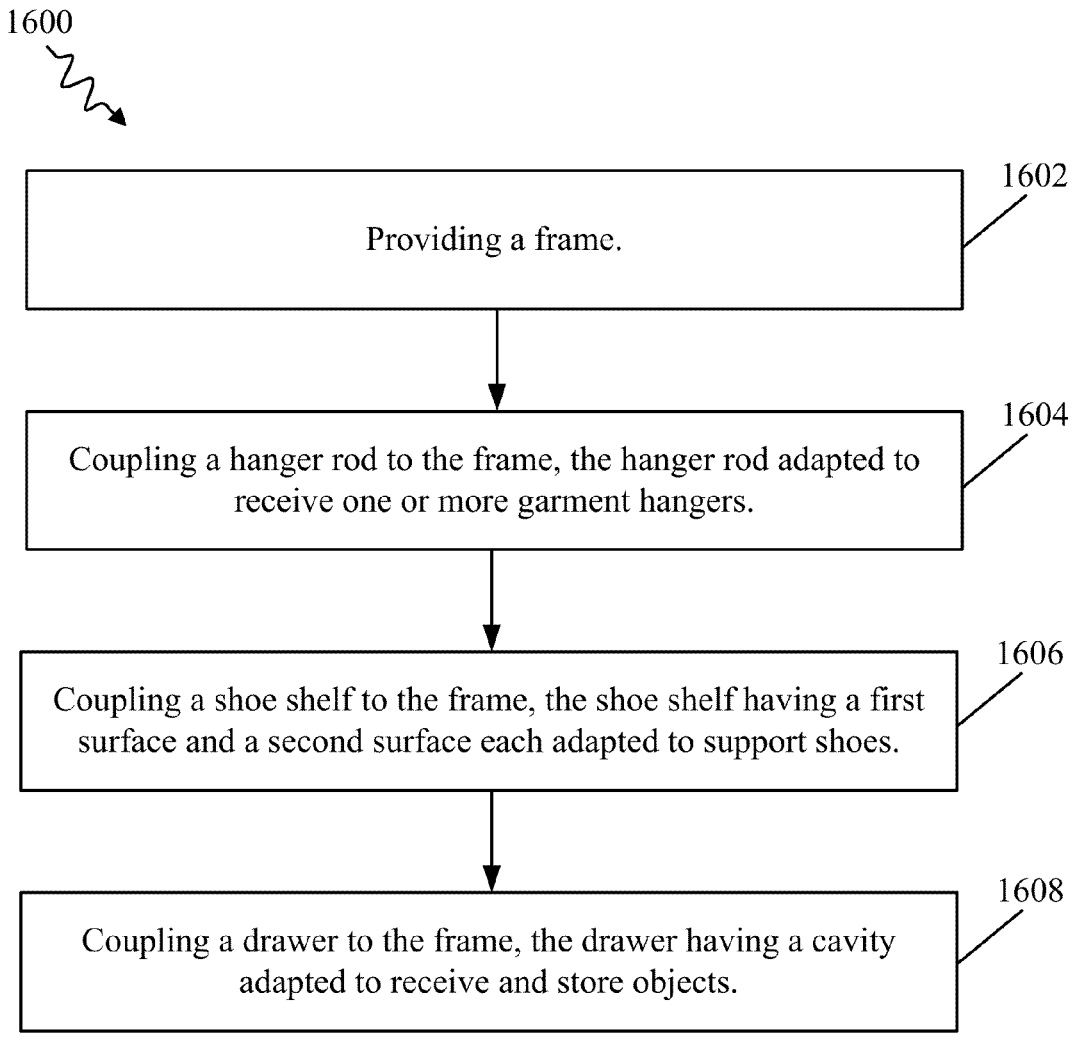
FIG. 16 illustrates a method of manufacturing a portable storage apparatus.

FIG. 16 illustrates a method 1600 of manufacturing a portable storage apparatus according to one embodiment. The method 1600 includes providing a frame 1602. Next, a hanger rod is coupled to the frame, where the hanger rod is adapted to receive one or more garment hangers 1604. Next, a shoe shelf is coupled to the frame, where the shoe shelf has a first surface and a second surface each adapted to support shoes 1606. Finally, a drawer is coupled to the frame, where the drawer has a cavity adapted to receive and store objects, such as clothing, toys, and/or books 1608.

One or more of the components and functions illustrated in the drawings may be rearranged and/or combined into a single component or embodied in several components without departing from the invention. Additional elements or components may also be added without departing from the invention. While certain exemplary embodiments have been described and shown in the accompanying drawings, it is to be understood that such embodiments are merely illustrative of and not restrictive of the present disclosure, and that the present disclosure should not be limited to the specific constructions and arrangements shown and described, since various other modifications are possible. Therefore, it is to be understood that, within the scope of the appended claims, embodiments of the present disclosure may be practiced other than as specifically described herein.

What is claimed is:

1. A portable organizer apparatus comprising:

a frame;

a hanger rod coupled to the frame and adapted to receive one or more garment hangers;

a shoe shelf coupled to the frame, the shoe shelf including a first member having a first surface and a second member having a second surface, the first and second surfaces each adapted to support outsoles of shoes, the shoe shelf further including a first lateral support member and a second lateral support member each adapted to support edges of the shoes, the first lateral support member coupled to a first end of the first member and the second lateral support member coupled to a first end of the second member, the first member having a second end coupled to a second end of the second member at an angle; and a drawer slideably coupled to the frame and adapted to be placed into an open position or a closed position, the drawer having a depth $d_3$, a height $h_4$, and a cavity adapted to receive and store at least one of toys, books, or clothing, the cavity of the drawer exposed when the drawer is placed into the open position, and wherein the shoe shelf is wholly positioned in between the hanger rod and the drawer such that the hanger rod is positioned on a first side of the shoe shelf and the drawer is positioned on a second side of the shoe shelf, the first side of the shoe shelf opposite the second side of the shoe shelf, the shoe shelf further positioned above the drawer at a distance $h_5$ that is less than 60% of the height $h_4$, the shoe shelf having a depth $d_4$ that is greater than 70% of the depth $d_3$ of the drawer, and the shoe shelf's depth $d_4$ and distance $h_5$ above the drawer causes the shoe shelf to directly and substantially cover the cavity of the drawer when the drawer is placed into the closed position.

2. The apparatus of claim 1, wherein the first and second surfaces of the first member and second member of the shoe shelf are angled with respect to each other at an angle $\alpha$ that is greater than or equal to 45 degrees and less than or equal to 165 degrees.

3. The apparatus of claim 2, wherein the first and second surfaces of the first member and second member of the shoe shelf are adjustable relative to one another so that the angle $\alpha$ is adjustable.

4. The apparatus of claim 1, wherein the frame comprises:

a first side support and a second side support, wherein a first surface of the first side support is coupled to a first end of the hanger rod and a first surface of the second side support is coupled to a second, opposing end of the hanger rod.

5. The apparatus of claim 4, wherein a second surface of the first side support is coupled to a first end of the shoe shelf, and a second surface of the second side support is coupled to a second, opposing end of the shoe shelf.

6. The apparatus of claim 5, wherein a front surface and a rear surface of the drawer are orthogonal to the second surfaces of the first and second side supports, and the first and second surfaces of the first member and the second member of the shoe shelf are also orthogonal to the second surfaces of the first and second side supports.

7. The apparatus of claim 5, wherein the first surface of the first side support has a depth that is narrower than a depth of the second surface of the first side support, and the first surface of the second side support has a depth that is narrower than a depth of the second surface of the second side support.

8. The apparatus of claim 4, wherein the first side support comprises a first upper side support and a first lower side support removeably coupled to each other, and the second side support comprises a second upper side support and a second lower side support removeably coupled to each other, the first upper side support coupled to the first end of the hanger rod and the second upper side support coupled to the second, opposing end of the hanger rod.

9. The apparatus of claim 8, wherein the first lower side support is coupled to a first end of the shoe shelf and the second lower side support is coupled to a second, opposing end of the shoe shelf.

10. The apparatus of claim 1, further comprising:

a plurality of wheels coupled to a bottom end of the frame.

11. The apparatus of claim 1, wherein the first and second surfaces of the first member and second member of the shoe shelf are adapted to display a plurality of shoes from both a front side of the apparatus and a rear, opposing side of the apparatus.

12. The apparatus of claim 1, wherein the drawer is a two-way drawer that can be opened from two, opposing sides of the apparatus.

13. A portable storage apparatus kit comprising:

a plurality of portable storage apparatus components packaged together for sale to consumers; and wherein the portable storage apparatus components comprises a frame having a first side support and a second side support, the first side support including a first surface that is parallel to and opposite of a first surface of the second side support, the first side support including a second surface that is parallel to and opposite of a second surface of the second side support, the first surface and second surface of the first side support parallel to each other and the first surface and second surface of the second side support parallel to each other, a hanger rod adapted to couple to the frame and adapted to receive one or more garment hangers, the hanger rod having a first end and a second end wherein the first end of the hanger rod is coupled to the first surface of the first side support and the second end of the hanger rod is coupled to the first surface of the second side support, a shoe shelf coupled to the frame, the shoe shelf including a first member having a first planar surface and a second member having a second planar surface, the first planar surface of the first member and the second planar surface of the second member each adapted to support outsoles of shoes, the first planar surface of the first member adapted to display one or more shoes from a front side of the apparatus and the second planar surface of the second member adapted to display one or more shoes from a rear, opposing side of the apparatus, the shoe shelf having a first end and a second end wherein the first end of the shoe shelf is coupled to the second surface of the first side support and the second end of the shoe shelf is coupled to the second surface of the second side support, the first member and second member each having an end that is coupled to each other at an angle, and a drawer adapted to slideably couple to the frame and adapted to be placed into an open position or a closed position, the drawer having a depth $d_3$, a height $h_4$, and a cavity adapted to receive and store objects, the cavity of the drawer exposed when the drawer is placed into the open position, and the drawer having a first end and a second end wherein the first end of the drawer is slideably coupled to the second surface of the first side support and the second end of the drawer is slideably coupled to the second surface of the second side support, the shoe shelf positioned in between the hanger rod and the drawer, the shoe shelf further positioned above the drawer at a distance $h_5$ that is less than 60% of the height $h_4$, the shoe shelf having a depth $d_4$ that is greater than 70% of the depth $d_3$ of the drawer, and the shoe shelf's depth $d_4$ and distance $h_5$ above the drawer causes the shoe shelf to directly and substantially cover the cavity of the drawer when the drawer is placed into the closed position.

14. A portable organizer apparatus comprising:

a frame having a first side support and a second side support, the first side support including a first surface that is parallel to and opposite of a first surface of the second side support, the first side support including a second surface that is parallel to and opposite of a second surface of the second side support, the first surface and second surface of the first side support parallel to each other and the first surface and second surface of the second side support parallel to each other;

a hanger rod coupled to the frame and adapted to receive one or more garment hangers, the hanger rod having a first end and a second end wherein the first end of the hanger rod is coupled to the first surface of the first side support and the second end of the hanger rod is coupled to the first surface of the second side support;

a shoe shelf coupled to the frame, the shoe shelf including a first member having a first planar surface and a second member having a second planar surface, the first planar surface of the first member and the second planar surface of the second member each adapted to support outsoles of shoes, the first planar surface of the first member adapted to display one or more shoes from a front side of the apparatus and the second planar surface of the second member adapted to display one or more shoes from a rear, opposing side of the apparatus, the shoe shelf having a first end and a second end wherein the first end of the shoe shelf is coupled to the second surface of the first side support and the second end of the shoe shelf is coupled to the second surface of the second side support, the first member and second member each having an end that is coupled to each other at an angle; and a drawer slideably coupled to the frame and adapted to be placed into an open position or a closed position, the drawer having a depth $d_3$, a height $h_4$, and a cavity adapted to receive and store at least one of toys, books, or clothing, the cavity of the drawer exposed when the drawer is placed into the open position, the drawer having a first end and a second end wherein the first end of the drawer is slideably coupled to the second surface of the first side support and the second end of the drawer is slideably coupled to the second surface of the second side support, the shoe shelf positioned in between the hanger rod and the drawer, the shoe shelf further positioned above the drawer at a distance $h_5$ that is less than 60% of the height $h_4$, the shoe shelf having a depth $d_4$ that is greater than 70% of the depth $d_3$ of the drawer, and the shoe shelf's depth $d_4$ and distance $h_5$ above the drawer causes the shoe shelf to directly and substantially cover the cavity of the drawer when the drawer is placed into the closed position.

15. The apparatus of claim 14, wherein the first and second planar surfaces of the first and second members are angled with respect to each other at an angle $\alpha$ that is greater than or equal to 45 degrees and less than or equal to 165 degrees.

16. The apparatus of claim 14, wherein the hanger rod and the shoe shelf are removeably coupled to the frame.

17. The apparatus of claim 14, wherein the drawer is a two-way drawer that can be opened from two, opposing sides of the apparatus.

18. The apparatus of claim 14, wherein a front surface and a rear surface of the drawer are orthogonal to the second surfaces of the first and second side supports, and the first and second planar surfaces of the first and second members are also orthogonal to the second surfaces of the first and second side supports.

19. The apparatus of claim 14, wherein the first side support comprises a first upper side support and a first lower side support removeably coupled to each other, and the second side support comprises a second upper side support and a second lower side support removeably coupled to each other, the first lower side support including the second surface of the first side support and the second lower side support including the second surface of the second side support, the first upper side support including the first surface of the first side support and the second upper side support including the first surface of the second side support, the first upper side support coupled to the first end of the hanger rod and the second upper side support coupled to the second end of the hanger rod.

20. The apparatus of claim 14, wherein the first surface of the first side support has a depth that is narrower than a depth of the second surface of the first side support, and the first surface of the second side support has a depth that is narrower than a depth of the second surface of the second side support.

* * * * *